US006745542B2

(12) United States Patent
Masumoto

(10) Patent No.: US 6,745,542 B2
(45) Date of Patent: Jun. 8, 2004

(54) SCREW CAPPER

(75) Inventor: Satoshi Masumoto, Ishikawa-ken (JP)

(73) Assignee: Shibuya Kogyo Co., Ltd., Ishikawa-ken (JP)

( * ) Notice: Subject to any disclaimer, the term of this patent is extended or adjusted under 35 U.S.C. 154(b) by 0 days.

(21) Appl. No.: 10/246,550

(22) Filed: Sep. 18, 2002

(65) Prior Publication Data

US 2003/0056468 A1 Mar. 27, 2003

(30) Foreign Application Priority Data

Sep. 25, 2001 (JP) ..... 2001-290877

(51) Int. Cl.[7] ..... B65B 7/28
(52) U.S. Cl. ..... 53/317; 53/331.5
(58) Field of Search ..... 53/75, 317, 490, 53/331.5, 331

(56) References Cited

U.S. PATENT DOCUMENTS 4,616,466 A * 10/1986 Tanaka et al. ..... 53/75
5,321,935 A * 6/1994 Spatz et al. ..... 53/490
5,400,564 A * 3/1995 Humphries et al. ..... 53/75
5,417,031 A * 5/1995 Bankuty et al. ..... 53/331.5
5,687,552 A * 11/1997 Barca ..... 53/490
6,105,343 A * 8/2000 Grove et al. ..... 53/490
6,519,913 B2 * 2/2003 Higashizaki et al. ..... 53/75

FOREIGN PATENT DOCUMENTS

JP 36957/1992 6/1992

* cited by examiner

*Primary Examiner*—Stephen F. Gerrity
*Assistant Examiner*—Hemant M Desai
(74) *Attorney, Agent, or Firm*—Flynn, Thiel, Boutell & Tanis, P.C.

(57) ABSTRACT

A gripper includes grip members which are mounted on a first rotary shaft and a second rotary shaft, respectively, so as to be opened and closed. An engaging pawl is formed on an upper surface of the grip member. Both shafts are elevatable in an integral manner. A receptacle member is disposed below an exit star-wheel, and is arranged to rotate integrally with the star-wheel. The gripper is located below the flange of the vessel when receiving the vessel. Accordingly, the engaging pawl cannot contact the flange. When the vessel is depressed by the capping head during a capping operation, the engaging pawl engages the vessel. When the vessel is discharged, the vessel remains suspended above the receptacle member, and the gripper then descends to place the vessel on the receptacle member and to disengage the engaging pawl of the gripper. Accordingly, there is no scarring of the vessel when the vessel is introduced into and discharged from the screw capper, and a stable conveyance of vessels is enabled.

10 Claims, 4 Drawing Sheets

SCREW CAPPER

BACKGROUND OF THE INVENTION AND RELATED STATEMENT

The invention relates to a screw capper which engages a cap held by a capping head around the threaded mouth of a vessel and tightens it.

A screw capper is widely used for engaging and tightening threads formed on the internal surface of a cap which is held by a capping head with threads formed around the mouth of vessel while the vessels are conveyed in the rotating condition as they are supported by vessel support members which are mounted on a revolving body, by causing a capping head which holds a cap which is formed with internal threads to rotate while moving down.

When tightening the cap by the capping head, if the cap is allowed to rotate together with the cap, a torque which is sufficient to tighten the cap around the mouth of the vessel is not obtained, leaving the likelihood of a liquid leak subsequently. In order to prevent the vessel from rotating when the cap is tightened around it, a capping operation usually takes place while firmly gripping the barrel of a vessel for high rigidity vessels such as glass bottles. However, vessels which are formed of pliable materials such as PET bottles which find an extensive application recently, there arises a likelihood that when the barrel is gripped, the vessel may be deformed to cause a liquid which is filled therein to spill through the mouth of the vessel. Accordingly, there is a proposal for a screw capper (see Japanese Patent Publication No. 36,957/1992) which is capable of preventing a vessel, formed of a pliant material such as PET vessel, from rotating during a tightening operation by the screw capper.

In the screw capper disclosed in the cited Publication, a star-wheel (suspension mechanism 5) is formed with an engaging disc-like projection (anti-rotation blade 6) at a position which bears against the lower surface of a flange on a plastics vessel 1 so that the engagement of the blade with the lower surface of the flange prevents the vessel from rotating. However, with this arrangement, when a vessel is introduced into the star-wheel or when it is discharged from the star-wheel, the lower surface of the flange may be scarred. In particular, during the capping operation when the cap is strongly urged against the vessel by the capping head to cause the flange to engage the disc-like projection, the lower surface of the flange may be seriously scarred if it is attempted to take the vessel out of the star-wheel to be discharged subsequent to the capping operation.

For this reason, in the screw capper disclosed in the cited Publication, upon completion of the capping operation, the bottom of the vessel is placed on a stationary skewed plate to push it up in a gradual manner, thus disengaging the flange from the engaging disc-like projection before the vessel is taken out. However, this arrangement in which the vessel is caused to slide up the skewed stationary plate in order to allow the flange of the vessel to be disengaged from the star-wheel has a drawback that the conveyance of vessels may become unstable.

OBJECT AND SUMMARY OF THE INVENTION

Accordingly, it is an object of the present invention to provide a screw capper which is free from the likelihood of scarring the lower surface of a flange of a vessel when the vessel is introduced into and discharged from the capper and which is capable of assuring a stable conveyance of vessels upon completion of the capping operation when the lower surface of the flange is to be disengaged from the engaging projection.

Above object is accomplished by a screw capper comprising conveying means including a plurality of support members, each capable of bearing against the lower surface of a flange formed around the mouth of a vessel, thus conveying the vessels while they are suspended by the support members, a capping head for threadably engaging and tightening a cap around the vessel which is being conveyed while it is suspended by the conveying means, and an engaging projection formed on the top surface of the support member and engageable with the lower surface of the flange, the arrangement being such that during the tightening operation of the cap, the capping head operates to depress the vessel through the cap to cause the lower surface of the flange to be engaged with the engaging projection in order to prevent the vessel from rotating. In accordance with the invention, the screw capper further comprises a receptacle member on which the vessel can be placed, and elevating means for elevating the support member, the arrangement being such that upon completion of tightening the cap around the vessel, the support member is caused to move down in order to place the vessel on the receptacle member, thus terminating the engagement of flange with the engaging projection.

With the screw capper constructed in the manner mentioned above, the vessel is discharged after the flange of the vessel is disengaged from the engaging projection by causing the support member to move down upon completion of the capping operation, thus avoiding the likelihood of scarring the vessel by the engaging projection. In addition, the flange of the vessel can be disengaged from the engaging projection in a reliable manner by causing the support member to descend to a location above the receptacle member before the vessel is discharged.

According to an invention the likelihood of the flange of the vessel being scarred by an engaging projection on a gripper is avoided when introducing the vessel into the screw capper. At this end, the support member comprises a gripper which grips a portion located below the flange of the vessel, and when conveying means receives the vessel, the gripper maintains a clearance with respect to the lower surface of the flange while gripping the vessel.

According to an invention, there is provided a screw capper which assures a stable conveyance of vessels when the lower surface of the flange is disengaged from the engaging projection upon completion of the capping operation. This object is accomplished by causing the receptacle member to move in substantially in the same direction and with a same speed as the vessel being conveyed at least in a region where the support member moves down to place the vessel on the receptacle member.

DETAILED DESCRIPTION OF PREFERRED EMBODIMENT

Figure 1:
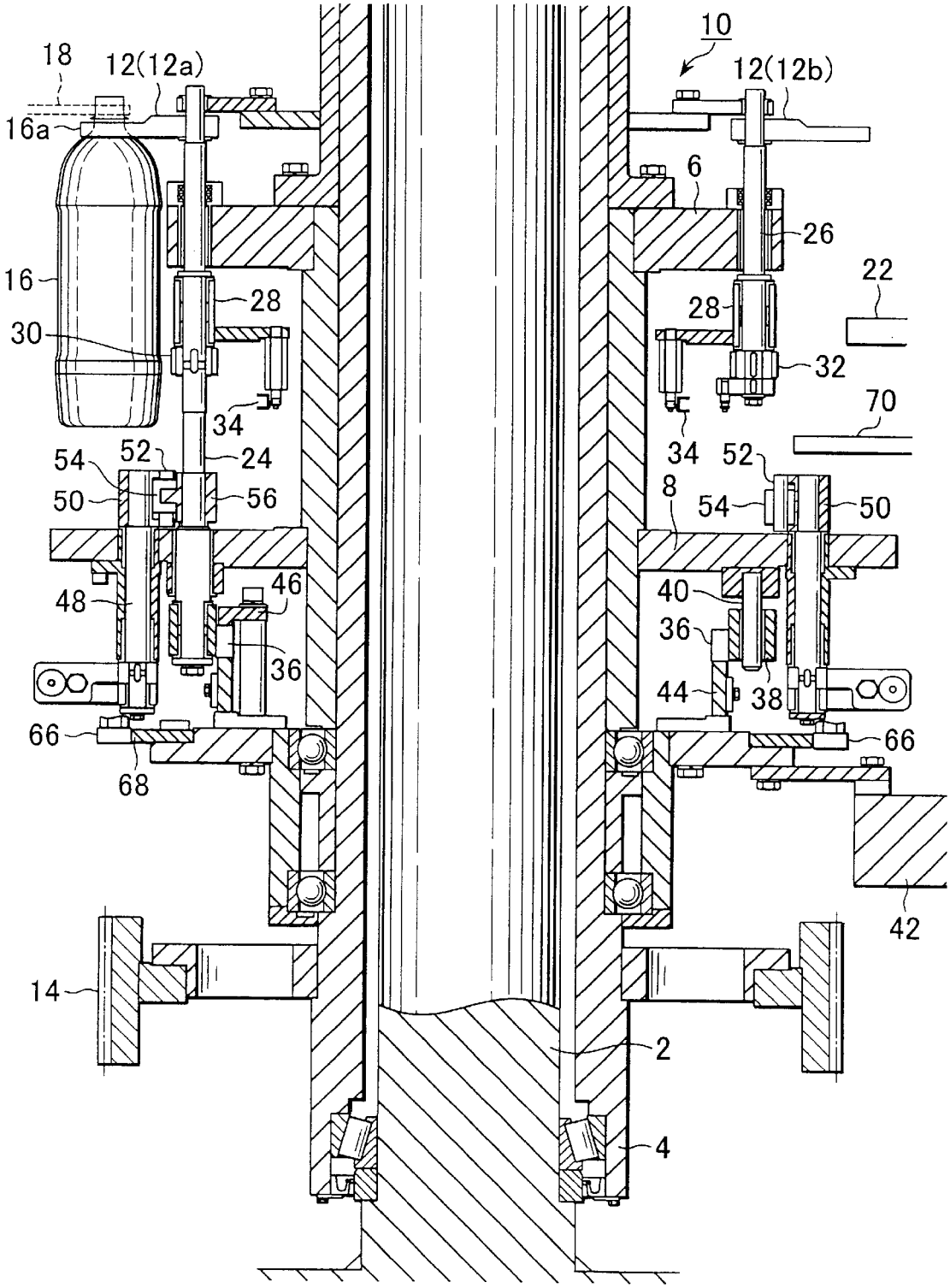
FIG. 1 is a longitudinal section of an essential part of a screw capper according to one embodiment of the present invention.

An embodiment of the present invention will now be described with reference to the drawings.

A stationary center shaft 2 rotatably carries a rotary cylinder 4 on which a pair of upper and lower rotary discs 6, 8 are fixedly mounted. A plurality of grippers (support members each supporting a vessel) 12 are mounted around the outer periphery of a revolving body 10 at an equal circumferential spacing, the revolving body 10 comprising the rotary cylinder 4 and the rotary discs 6, 8. The revolving body 10 is driven from a drive source, not shown, for rotation through a gear 14. The revolving body 10 defines conveying means, which rotatively conveys vessels which are supported by the grippers 12.

A vessel 16 which is filled with a liquid by an upstream filler is handed over to each gripper 12 of the screw capper while a portion of the vessel which is located above a flange 16*a* is gripped by a gripper 18 on an intermediate wheel. While the vessel 16 is conveyed as suspended by the gripper 12 on the screw capper which engages a portion of the vessel located below the flange 16*a*, a capping operation of the vessel takes place by a capping head 20 (shown in FIGS. 5A–5D and to be described later) which is disposed above each gripper 12 to be delivered to an exit star-wheel 22.

Each gripper 12 on the screw capper comprises a pair of grip members 12*a*, 12*b*, which may be opened and closed to hold the vessel 16 at a location below the flange 16 formed around the mouth thereof or to release it. On its upper surface, each of the grip members 12*a*, 12*b* is formed with an engaging pawl (or engaging projection) 12*c* which engages the lower surface of the flange 16*a* of the vessel 16 to prevent the vessel 16 from rotating during the time a cap 23 is to be tightened (see FIGS. 5A and 5D which will be described later).

A mechanism which opens/closes and elevates the both grip members 12*a*, 12*b* of the gripper 12 will now be described. A first rotary shaft 24 extends through the upper and the lower rotary disc 6, 8 in a rotatable and elevatable manner. The first grip member 12*a* is mounted on the top end of the first rotary shaft 24 for integral rotation therewith. A second rotary shaft 26 is disposed adjacent to the first rotary shaft 24 and extends through the upper rotary disc 6 in an rotatable and elevatable manner, and the second grip member 12*b* is mounted on the top end of the second rotary shaft 26 for integral rotation therewith. The first rotary shaft 24 and the second rotary shaft 26 are connected together by a connecting member 28 (see FIG. 2) and are caused to move up and down integrally by an elevating mechanism to be described later.

Figure 2:
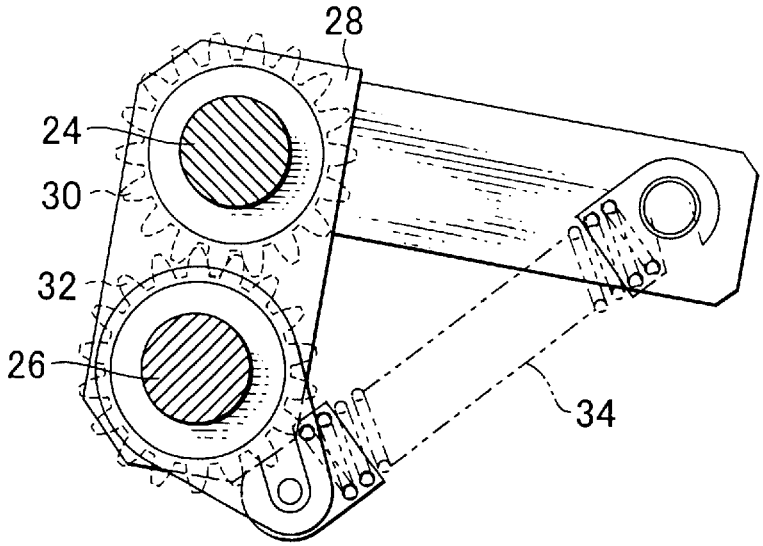
FIG. 2 is a cross section of a mechanism which opens and closes a pair of grip members.

A first pinion 30 is fixedly mounted on the first rotary shaft 24 intermediate its length and meshes with a second pinion 32 which is fixedly mounted on the lower end of the second rotary shaft 26. Accordingly, when one of the rotary shafts 24, 26, which is the first rotary shaft 24 in the embodiment shown, rotates, the other rotary shaft 26 rotates in the opposite direction, whereby the both grip members 12*a*, 12*b* which are mounted on the respective rotary shafts 24, 26 open or close. As shown in FIG. 2, the second rotary shaft 26 is urged by a tension spring 34 in a direction to maintain the both grip members 12*a*, 12*b* normally open.

A block 38 on which an elevating cam follower 36 is mounted is fitted onto the lower end of the first rotary shaft 24 in a manner to permit a relative rotation therebetween. A pin 40 which is secured to the lower surface of the lower rotary disc 8 extends through the block 38 on the opposite side to serve as a stop for the rotation of the block 38 on which the elevating cam follower 36 is mounted (see FIGS. 1 and 3). The elevating cam follower 36 rides on an upper surface of an elevating cylindrical cam 44 mounted on a stationary body 42 which is mounted outside the revolving body 10 of the screw capper, and moves up and down in accordance with the cam profile of the cylindrical cam 44, thus causing the first rotary shaft 24 to move up and down. The combination of the elevating cam follower 36 and the elevating cylindrical cam 44 forms together elevating means which operates to elevate the gripper (support member).

When the first rotary shaft 24 elevates in accordance with the elevating means, this motion is transmitted through the connection member 28 to cause the second rotary shaft 26 to elevate also in an integral manner. An upper cam 46 which opposes the cylindrical cam 44 is mounted in a region of the elevating cylindrical cam 44 which acts to cause the first rotary shaft 24 to move down, whereby the elevating cam follower 36 is held sandwiched between the cylindrical cam 44 and the upper cam 46 to cause the first rotary shaft 24 to move down in a reliable manner.

The lower portion of the first rotary shaft 24 extends through the lower rotary disc 8 of the revolving body 10. A rotation transmitting shaft 48 is rotatably mounted in the lower rotary disc 8 at a location adjacent to the first rotary shaft 24. An upper end portion of the rotation transmitting shaft 48 which projects above the lower rotary disc 8 fixedly carries a first block 50 which serves transmitting the rotation (see FIGS. 1 and 4). Toward the first rotary shaft 24, a vertical roller shaft 52 is mounted on the first block 50, and a roller 54 is fitted on the roller shaft 52 in an elevatable and rotatable manner.

Figure 4:
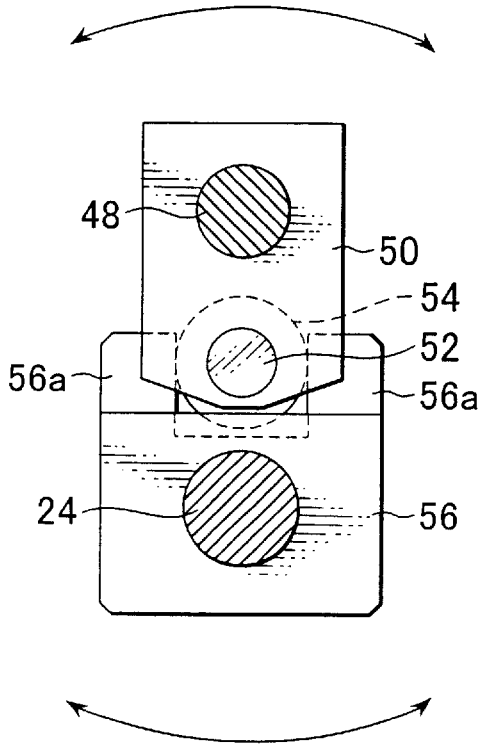
FIG. 4 is a cross section of a drive transmission assembly associated with a rotary shaft which causes the grip members to rotate.

On the other hand, a second block 56 which serves transmitting the rotation is fixedly mounted on a portion of the first rotary shaft 24 which is located above the lower rotary disc 8 or at the same elevation as the first block 50. As shown in FIG. 4, holders which surround the roller 54, both vertically above and below it and on the left and right sides thereof, are mounted on the second block 56 toward the first block 50 (only the holders 56*a* which surround the left and right sides are shown). Accordingly, as the rotation transmitting shaft 48 rotates, the first block 50 rotates in an integral manner, and consequently, the second block 56 rotates, and the first rotary shaft 24 rotates integrally with the second block 56, but in the opposite direction from the rotation transmitting shaft 48.

In this manner, the rotation of the rotation transmitting shaft 48 is transmitted to the first rotary shaft 24 through the first block 50, the roller 54 and the second block 56, while permitting an elevating motion of the first rotary shaft 24 under the control of the elevating cylindrical cam 44 relative to the first block 50 by allowing the roller 54 which is held by the second block 56 to elevate.

Figure 3:
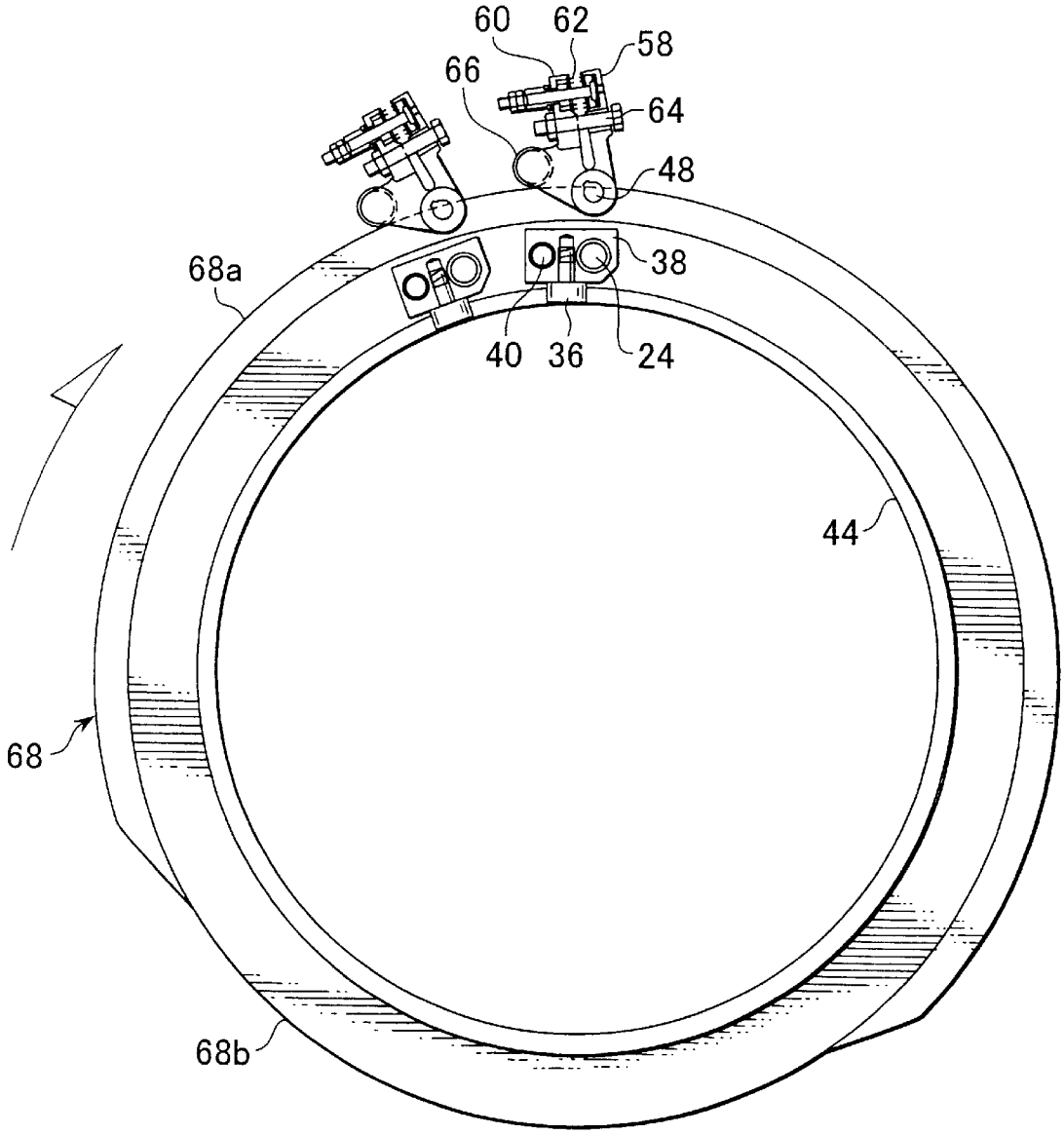
FIG. 3 is a plan view of an elevating cam and an opening/closing cam for the gripper.

A first lever 58 is fixedly carried by the lower end of the rotation transmitting shaft 48 for integral rotation (see FIG. 3). A second lever 60 is also rotatably carried by the rotation transmitting shaft 48. A spring 62 is disposed between the opposite ends of the both levers 58, 60 to urge them in a direction to maintain them apart. A stop pin 64 extends through the both levers 58, 60 at a location nearer the rotation transmitting shaft 48 than the ends of the levers 58, 60, thus controlling the open positions of the both levers 58, 60.

A gripper opening/closing cam follower 66 is mounted on the second lever 60, and is resiliently urged against a gripper opening/closing horizontal cam 68 (see FIGS. 1 and 3)

which is fixedly mounted on the stationary body 42 which is disposed outside the revolving body 10. When the second lever 60 on which the gripper opening/closing cam follower 66 is mounted rocks in accordance with the cam profile of the horizontal cam 68, this rocking motion is transmitted through the spring 62 to the first lever 58, thus causing the rotation transmitting shaft 48 to rotate. The resulting rotation of the rotation transmitting shaft 48 is transmitted through the first block 50, the roller 54 and the second block 56 to rotate the first rotary shaft 24 in the opposite direction, in a manner mentioned above, and the second rotary shaft 26 is caused to rotate in the opposite direction from the first rotary shaft 24 through the pinions 30, 32, thus opening and closing the both grip members 12*a*, 12*b* of the gripper 12. As shown in FIG. 3, the gripper opening/closing horizontal cam 68 includes a portion 68*a* of an increased diameter and a portion 68*b* of a reduced diameter. When the cam follower 66 moves along the portion 68*b* of a reduced diameter, the gripper 12 is opened while the gripper 12 is closed when the cam follower 66 is moving along the portion 68*a* of an increased diameter.

As mentioned previously, the both grip members 12*a*, 12*b* are normally urged by the tension spring 34 in a direction to open the gripper, and are opened and closed by the opening/closing horizontal cam 68. When the opening/closing cam follower 66 shifts to the portion 68*a* of an increased diameter of the horizontal cam 68, the gripper 12 is closed and is maintained closed. The force which acts to close the gripper 12 is buffered by the spring 62 disposed between the first lever 58 and the second lever 60.

An intermediate wheel which hands over the vessel 16 which is filled with a liquid by a filler, not shown, is disposed upstream of the screw capper mentioned above (while not shown, the intermediate wheel is disposed to the left of FIG. 1). An exit star-wheel 22 which discharges the capped vessel 16 from the screw capper to a subsequent step is disposed downstream of the screw capper (or to the right of FIG. 1). The exit star-wheel 22 is constructed in a manner well known in the art, and therefore is not shown in detail. Briefly, around its outer periphery, the exit star-wheel is formed with pockets at an equal circumferential spacing, and each pocket is adapted to receive the vessel 16 from the gripper 12 of the screw capper for rotatively conveying it. A receptacle member 70 on which the vessel 16, delivered from the screw capper, is placed is disposed below the exit star-wheel 22, and is arranged to rotate integrally with the star-wheel 22. The star-wheel 22 and the receptacle member 70 rotate synchronously with the revolving body 10 of the screw capper, but in the opposite direction.

The operation of the screw capper mentioned above will now be described with reference to FIGS. 1 to 4 and FIGS. 5A to 5D. The vessel 16 which is filled with a liquid by a filler, not shown, is conveyed while an upper portion thereof which is located above the flange 16*a* is suspended by the gripper 18 on the intermediate wheel, and is then handed over to the gripper 12 of the screw capper.

At the time when the gripper 12 of the screw capper receives the vessel 16, the opening/closing cam follower 66 bears against the portion 18*b* of a reduced diameter of the horizontal cam 68, whereby the both grip members 12*a*, 12*b* are in their open positions. The first rotary shaft 24 assumes its raised position under the control of the elevating cylindrical cam 44. At the raised position of the gripper 12, a clearance is formed between the lower surface of the flange 16*a* of the flange 16 which is held by the gripper 18 of the intermediate wheel and the engaging pawl 12*c* formed on the upper surface of the gripper 12.

When the vessel 16 which is held by the gripper 18 of the intermediate wheel is inserted between the both grip members 12*a*, 12*b* which assume such positions as the revolving body 10 rotates, the opening/closing cam follower 66 shifts to the portion 68*a* of an increased diameter of the horizontal cam 68, whereupon the second lever 60 rocks, causing the first lever 58 to rock through the spring 62. As a result of the rocking motion of the first lever 58, the rotation transmitting shaft 68 rotates integrally therewith. When the rotation transmitting shaft 48 rotates, the first block 50 and the roller 54 which are fixedly mounted on the top end of the rotation transmitting shaft 48 rock integrally, and the second block 56 which holds the roller 54 and the first rotary shaft 24 rotate in the opposite direction from the rotation transmitting shaft 48.

The rotation of the first rotary shaft 24 is transmitted through the pinions 30, 32 to the second rotary shaft 26, which then rotates in the opposite direction from the first rotary shaft 24, thus driving the first grip member 12*a* and the second grip member 12*b* which are mounted on the first rotary shaft 24 and the second rotary shaft 26, respectively, toward each other, thus gripping a portion of the vessel 16 which is located below the flange 16*a*. As mentioned previously, at this time, there is a clearance between the engaging projection (engaging pawl) 12*c* of the gripper 12 and the lower surface of the flange 16*a*, avoiding any scarring of the lower surface of the flange 16*a* by the engaging pawl 12*c*. After the gripper 12 of the screw capper has gripped the vessel 16, the gripper 18 on the intermediate wheel releases the vessel 16, whereby the vessel 16 is suspended by the gripper 12 (see FIG. 5A).

Subsequently, a capping head 20 disposed above each gripper 12 moves down while holding a cap 23. As the capping head 20 moves down, it depresses the vessel 16 through the cap 23 to urge the flange 16*a* against the engaging pawl 12*c* which is formed on the upper surface of the gripper 12, thus engaging the flange 16*a* with the engaging pawl 12*c*. In order to facilitate urging the flange 16*a* of the vessel 16 against the engaging pawl 12*c* on the gripper 12, the force with which the gripper 12 holds the vessel may be slightly reduced. In such instance, a zone of a slightly smaller diameter may be defined within the portion 68*a* of an increased diameter of the opening/closing horizontal cam 68.

The capping head 20 which carries the cap 23 then descends while rotating, thus engaging the cap 23 and tightening it around the mouth of the vessel 16. At this time, because the engaging pawl 12*c* is engaged with the lower surface of the flange 16*a*, any rotation of the vessel 16 can be positively prevented (see FIG. 5B), and thus the cap 23 can be connected to the vessel 16 with a required clamping torque. Where the force with which the gripper 12 grips the vessel is reduced when the flange 16*a* of the vessel 16 is urged against the engaging pawl 12*c* on the gripper 12, it should be understood that the gripping force of the gripper 12 must be increased when tightening the cap 23.

Figure 5A:
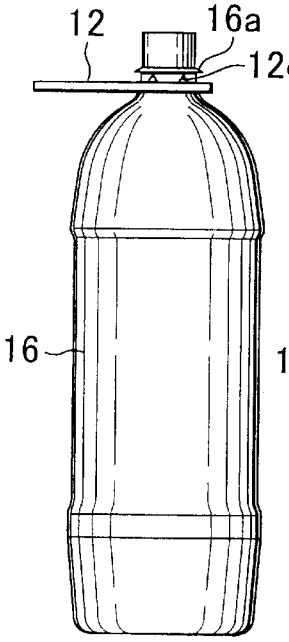
FIGS. 5A, 5B, 5C and 5D are illustrations of sequential steps from the introduction to the discharge of a vessel into and from the screw capper.
Figure 5B:
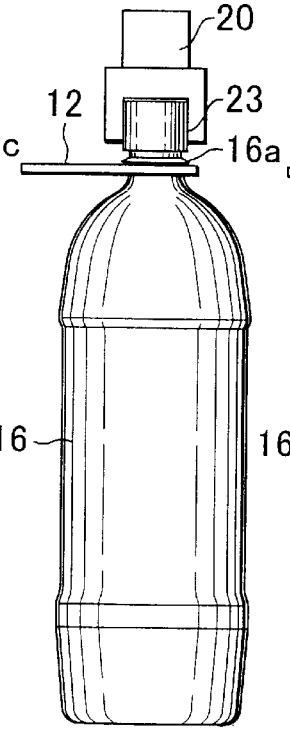
Figure 5C:
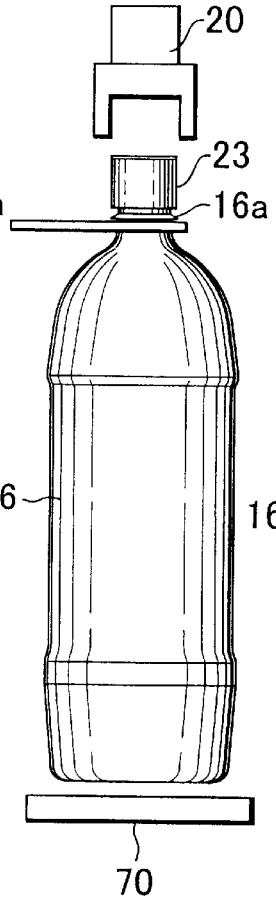

Upon completion of the capping operation, the capping head 20 releases the cap 23 and moves upward (see FIG. 5C), and the gripper 12 of the screw capper hands over the vessel 16 to the exit star-wheel 22, thus discharging it from the screw capper. When discharging the vessel, it should be noted that at the time the gripper 12 reaches a position where it overlies the exit star-wheel 22 and the receptacle member 72 while holding a portion of the vessel 16 located below the flange 16*a*, the lower surface of the vessel 16 is spaced above the receptacle member 70, as shown in FIG. 5C. Subsequently, the elevating cylindrical cam 44 and the upper cam 46 causes the elevating cam follower 36 to descend, whereby the first rotary shaft 24 on which the cam follower 36 is mounted descends. The first rotary shaft 24 and the second rotary shaft 26 are connected together through the connection member 28 to move up and down in an integral manner, and thus the both shafts 24, 26 descend and thus the gripper 12 (or the both grip members 12*a*, 12*b*) descends.

Figure 5D:
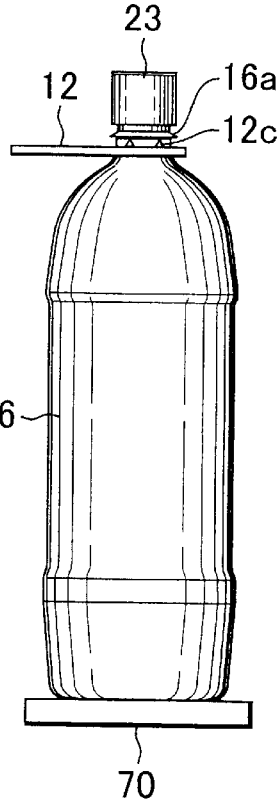

When the gripper 12 descends, the lower surface of the vessel 16 is placed on the receptacle member 70 initially, and as the gripper descends further, the engaging pawl 12*c* of the gripper 12 is disengaged from the lower surface of the flange 16*a* of the vessel 16, creating a clearance with respect to the flange 16*a* (see FIG. 5D). Subsequently, as the revolving body 10 of the screw capper and the exit star-wheel 22 rotate, the gripper 12 is opened to hand over the vessel 16 to the exit star-wheel 22. When the gripper 12 is caused to descend in order to place the vessel 16 on the receptacle member 70 and is caused to descend further, the engaging pawl 12*c* of the gripper 12 can be positively disengaged from the lower surface of the flange 16*a* of the vessel 16, eliminating any likelihood that the vessel 16 may be scarred during the discharge process. Since the receptacle member 70 is moving substantially in the same direction and substantially at the equal speed as the revolving body 10 of the screw capper, there is no concern that the conveyance of the vessel 16 may become unstable.

While in the description of the embodiment, the support member which supports and conveys the vessel 16 comprises the gripper 12 including the pair of grip members 12*a*, 12*b* which can be opened and closed, it should be understood that such support member is not limited to an opening/closing gripper 12, but may comprise any other support member which does not open or close, but simply supports the lower surface of the flange 16*a*. In addition, the receptacle member 70 which rotates integrally with the exit star-wheel 22 may comprise a single rotary disc or may comprise a bottle receptacle which is individually associated with a separate vessel 16. Furthermore, the receptacle member 70 may be disposed toward the screw capper rather than toward the exit star-wheel 22 so as to rotate integrally with the revolving body 10.

As mentioned, with the screw capper according to the present invention, when a vessel is introduced into or discharged from a screw capper, an engaging projection cannot contact a flange of the vessel and thus there is no damage to the engaging projection or no scarring of the vessel. Because there is no contact between the engaging projection and the vessel at locations where the vessel is introduced into or discharged from the screw capper, the conveyance of vessels cannot become unstable. The provision of the receptacle which moves in the direction in which the vessel is conveyed and on which the receptacle is placed to be discharged avoids any factor which causes an instability in the conveyance of the vessels which might be experienced when sliding the vessels on a stationary plate.

What is claimed is:

1. A screw capper having conveying means including a plurality of support members, each capable of supporting a lower surface of a flange formed around a mouth of a vessel, thus conveying the vessel as suspended by the support member, a capping head for engaging a cap and tightening the cap around the vessel as the vessel is conveyed while being suspended by the conveying means, and an engaging projection formed on an upper surface of the support member and engagable with the lower surface of the flange, the arrangement being such that when the capping head tightens the cap, the capping head depresses the vessel through the cap to cause the lower surface of the flange to be engaged with the engaging projection to prevent the vessel from rotating;

further comprising a receptacle member on which the vessel can be placed;

and elevating means for elevating the support member, the elevating means causing the support member to descend upon completion of tightening the cap to place the vessel on the receptacle member and to disengage the engaging projection from the lower surface of the flange.

2. A screw capper according to claim 1, in which the support member comprises a gripper which grips a portion of the vessel which is located below the flange, the gripper gripping the vessel with a clearance from the lower surface of the flange when the conveying means receives the vessel.

3. A screw capper according to claim 1, in which the receptacle member is arranged to move substantially in the same direction and at an equal speed as the vessel being conveyed at least in a region where the support member descends to place the vessel on the receptacle member.

4. A screw capper according to claim 3, further comprising a wheel disposed downstream of the screw capper for discharging the capped vessel, the receptacle member being disposed below the wheel for integral rotation therewith.

5. A vessel-capping device for closing an opening of a vessel comprising:

a conveying device for conveying the vessel;

a gripping apparatus including an engaging projection formed on an upper surface for supporting a lower surface of a flange formed around a mouth of the vessel;

a capping head for engaging a cap and tightening the cap to close the opening of the vessel;

a receptacle member for receiving the vessel thereon; and an elevating device for moving the gripping apparatus relative to the receptacle member, wherein when the capping head tightens the cap, the capping head depresses the vessel through the cap to engage the lower surface of the flange with the engaging projection of the gripping apparatus to prevent the vessel from rotating, and wherein, after completion of tightening of the cap onto the vessel, the elevating device lowers the gripping apparatus relative to the receptacle member so that the engaging projection of the gripping apparatus disengages from the lower surface of the flange.

6. A vessel-capping device according to claim 5, wherein the gripping apparatus is mounted to the conveying device.

7. A vessel-capping device according to claim 5, wherein when the vessel is initially received, the gripping apparatus grips the mouth of the vessel so that the engaging projection of the gripping apparatus is spaced from the lower surface of the flange.

8. A vessel-capping device according to claim 5, including a wheel disposed downstream of the capping head for discharging the vessel, and wherein the receptacle member is disposed below the wheel for integral rotation therewith.

9. A vessel-capping device according to claim 5, wherein after completion of tightening of the cap onto the vessel, the elevating device lowers the gripping apparatus relative to the receptacle member so that the engaging projection of the gripping apparatus disengages from the lower surface of the flange.

10. A vessel-capping device according to claim 5, wherein the engaging projection comprises one of a plurality of engaging projections.

* * * * *